US010283247B2

(12) United States Patent
Nagai et al.

(10) Patent No.: US 10,283,247 B2
(45) Date of Patent: May 7, 2019

(54) MULTILAYER COIL COMPONENT

(71) Applicant: TDK CORPORATION, Tokyo (JP)

(72) Inventors: Yuusuke Nagai, Tokyo (JP); Masazumi Arata, Tokyo (JP); Kenji Komorita, Tokyo (JP); Yoshimitsu Satoh, Tokyo (JP)

(73) Assignee: TDK CORPORATION, Tokyo (JP)

( * ) Notice: Subject to any disclaimer, the term of this patent is extended or adjusted under 35 U.S.C. 154(b) by 449 days.

(21) Appl. No.: 15/213,962

(22) Filed: Jul. 19, 2016

(65) Prior Publication Data

US 2017/0025219 A1 Jan. 26, 2017

(30) Foreign Application Priority Data

Jul. 24, 2015 (JP) ..... 2015-146575

(51) Int. Cl.
*H01F 17/00* (2006.01)

(52) U.S. Cl.
CPC ... *H01F 17/0013* (2013.01); *H01F 2017/002* (2013.01)

(58) Field of Classification Search
CPC ..... H01F 17/0013; H01F 2017/002
See application file for complete search history.

(56) References Cited

U.S. PATENT DOCUMENTS

2009/0051476 A1* 2/2009 Tada ..... H01F 17/0013 336/105
2010/0194513 A1* 8/2010 Ozawa ..... H01F 17/0013 336/200
2011/0128109 A1 6/2011 Tada et al.
2013/0234285 A1* 9/2013 Hijioka ..... H01F 17/0013 257/531
2014/0225702 A1* 8/2014 Yazaki ..... H01F 17/0013 336/200
2015/0014042 A1* 1/2015 Noguchi ..... H05K 1/165 174/262

FOREIGN PATENT DOCUMENTS

CN 101390176 A 3/2009
JP 2010-153617 A 7/2010
JP 2010153617 A * 8/2010 ..... H01F 17/00
JP 2010-192715 A 9/2010
JP 2015-018852 A 1/2015
KR 2008-0091778 A 10/2008
KR 2013-0019195 A 2/2013
KR 20130019195 A * 2/2013 ..... H01F 17/00

* cited by examiner

*Primary Examiner* — Mang Tin Bik Lian
*Assistant Examiner* — Malcolm Barnes
(74) *Attorney, Agent, or Firm* — Oliff PLC

(57) ABSTRACT

In a multilayer coil component, even when both pairs of ends of a first coil part and a second coil part are located at the same positions when viewed from the laminated direction and have the same shapes, a connecting part is connected only to a second end of the first coil part on the upper side in the laminated direction, and is connected only to a first end of the second coil part on the lower side in the laminated direction. Thus, a coil wound around along the laminated direction is structured without misaligning the positions of respective connecting parts. Consequently, the entire shapes of the respective coil parts can be designed to be the exact same shape, which makes it possible to reduce the number of types of coil part, saving labor and time for preparing many types of conductor patterns like the conventional type.

10 Claims, 5 Drawing Sheets

MULTILAYER COIL COMPONENT

CROSS-REFERENCE TO RELATED APPLICATIONS

This application is based upon and claims the benefit of priority from Japanese Patent Application No. 2015-146575, filed on Jul. 24, 2015, the entire contents of which are incorporated herein by reference.

TECHNICAL FIELD

The present disclosure relates to a multilayer coil component.

BACKGROUND

A DC-DC converter mounting thereon a coil component has been used in an electric power source of a mobile communication terminal, etc. A laminated type coil component (multilayer coil component) is used as the above coil component from the standpoints of downsizing, etc. Such a multilayer coil component is disclosed in, for example, Japanese Unexamined Patent Publication No. 2010-192715.

In this regard, when a via hole conductor connecting coil conductors adjacent to each other in a laminated direction is arranged inside a coil formation area in plan view like the multilayer coil component disclosed in Japanese Unexamined Patent Publication No. 2010-192715, an end of the coil conductor connected to the via hole conductor enters inside the coil, substantively reducing the coil inner diameter. Such a reduced coil inner diameter makes it difficult to yield sufficient coil characteristics (for example, inductance and Q-value).

Japanese Unexamined Patent Publication No. 2015-18852 has proposed a technique that prevents reduction of coil inner diameter by disposing a conductive pattern having functions same as those of the via hole conductor in the coil formation area in plan view.

SUMMARY

However, in the multilayer coil component disclosed in Japanese Unexamined Patent Publication No. 2015-18852, positions of respective connecting parts connecting the conductor patterns adjacent vertically to each other in the laminated direction are misaligned in plan view. This is because the positions of respective connecting parts need to be misaligned to form the coil wound around along the vertical direction because ends of the upper and lower conductor patterns are overlapped to each other at the connecting part.

When positions of respective connecting parts are misaligned in plan view like the multilayer coil in Japanese Unexamined Patent Publication No. 2015-18852, many types of conductor patterns need to be prepared to match the position of each connecting part. Consequently, labor and time is needed to prepare each conductor pattern, failing to easily manufacture the coil component.

The disclosure provides a multilayer coil component that reduces the number of types of coil part structuring a coil.

A multilayer coil component according to an aspect of the present disclosure is a multilayer coil component having a laminated structure and including a coil in an insulating body, including: a first coil part that structures a part of the coil, extends in a layer structuring the laminated structure, and has a divided portion and a pair of ends formed of a first end and a second end sandwiching the divided portion; a second coil part that structures a part of the coil, extends in a layer structuring the laminated structure, and has a divided portion and a pair of ends, the second coil part being positioned on a lower side of the first coil part in a laminated direction, the divided portion and the pair of ends of the second coil part having shapes same as shapes of the divided portion and the pair of ends of the first coil part and being located at positions same as positions of the divided portion and the pair of ends of the first coil part when viewed from the laminated direction; and a connecting part having a layer shape interposed between the first coil part and the second coil part and extended along the shape of the divided portion of the first coil part to connect the first coil part and the second coil part, wherein in the pairs of ends of the first coil part and the second coil part, the first end has an upper portion and a lower portion in the laminated direction, the upper portion being extended on a side of the second end more than the lower portion, and the second end has an upper portion and a lower portion in the laminated direction, the lower portion being extended on a side of the first end more than the upper portion, and the connecting part is connected only to the second end of the pair of ends of the first coil part on an upper side in the laminated direction, and is connected only to the first end of the pair of ends of the second coil part on a lower side in the laminated direction.

In the above multilayer coil component, even when both pairs of ends of the first coil part and the second coil part are located at the same positions when viewed from the laminated direction and have the same shapes, the connecting part is connected only to the second end of the first coil part on the upper side in the laminated direction, and is connected only to the first end of the second coil part on the lower side in the laminated direction. Thus, for example, when a connecting part is further provided on the upper side of the first coil part or on the lower side of the second coil part, a coil wound around along the laminated direction is structured without misaligning the positions of the respective connecting parts. Consequently, the entire shapes of the respective first coil parts and the second coil parts can be designed to be the exact same shape, which makes it possible to reduce the number of types of coil part, saving labor and time for preparing many types of conductor patterns like the conventional type.

The multilayer coil component may include a plurality of coil parts each structuring a part of the coil, extending in a layer structuring the laminated structure, and having a divided portion and a pair of ends, the divided portion and the pair of ends having shapes same as the shapes of the divided portion and the pair of ends of the first coil part and being located at positions same as the positions of the divided portion and the pair of ends of the first coil part when viewed from the laminated direction, and a plurality of connecting parts alternately aligned with the plurality of the coil parts, each of the plurality of connecting parts being located at a position same as a position of the connecting part when viewed from the laminated direction and having a shape same as a shape of the connecting part. Each of the plurality of connecting parts is connected only to the second end of the pair of ends of a corresponding one of the plurality of coil parts positioned on the upper side in the laminated direction, and is connected only to the first end of the pair of ends of a corresponding one of the plurality of coil parts positioned on the lower side in the laminated direction. In this case, a coil can be structured in which the plurality of coil parts and the plurality of connecting parts are alternately aligned without misaligning the positions of the respective plurality of connecting parts. This makes it possible to design the entire shapes of the respective coil parts to be the exact same shape, reducing the number of types of the coil parts.

A multilayer coil component according to another aspect of the present disclosure is a multilayer coil component having a laminated structure and including a coil in an insulating body, including: a first coil part that structures a part of the coil, extends in a layer structuring the laminated structure, and has a pair of ends formed of a first end and a second end being separated by a predetermined length and opposed to each other; a second coil part that structures a part of the coil, extends in a layer structuring the laminated structure, and has a pair of ends, the second coil part being positioned on a lower side of the first coil part in a laminated direction, the pair of ends of the second coil part having shapes same as shapes of the pair of ends of the first coil part and being located at positions same as positions of the pair of ends of the first coil part when viewed from the laminated direction; and a connecting part having a layer shape interposed between the first coil part and the second coil part and extended along an opposing direction of the pair of ends to connect the first coil part and the second coil part, wherein in each of the pairs of ends of the first coil part and the second coil part, given that an upper end position and a lower end position of the first end in the laminated direction are an a point and a b point, respectively, and an upper end position and a lower end position of the second end in the laminated direction are a c point and a d point, respectively, in a vertical section parallel to the opposing direction of the pair of ends, the b point, the a point, the d point, and the c point are aligned without overlapping in this order from a side of the first end in the opposing direction, a length D of the connecting part is longer than a separation distance between the a point and the d point, and shorter than a separation distance between the b point and the c point in the opposing direction, and the connecting part is connected only to the second end of the pair of ends of the first coil part on an upper side in the laminated direction, and is connected only to the first end of the pair of ends of the second coil part on a lower side in the laminated direction.

In the above multilayer coil component, even when both pairs of ends of the first coil part and the second coil part are located at the same positions when viewed from the laminated direction and have the same shapes, the connecting part is connected only to the second end of the first coil part on the upper side in the laminated direction, and is connected only to the first end of the second coil part on the lower side in the laminated direction. Thus, for example, when a connecting part is further provided on the upper side of the first coil part or on the lower side of the second coil part, a coil wound around along the laminated direction is structured without misaligning the positions of the respective connecting parts. Consequently, the entire shapes of the respective first coil parts and the second coil parts can be designed to be the exact same shape, which makes it possible to reduce the number of types of coil part structuring the coil, saving labor and time for preparing many types of conductor patterns like the conventional type.

The multilayer coil component may include a plurality of coil parts each structuring a part of the coil, extending in a layer structuring the laminated structure, and having a pair of ends, each of the pair of ends having shapes same as the shapes of the pair of ends of the first coil part and being located at positions same as the positions of the pair of ends of the first coil part when viewed from the laminated direction, and a plurality of connecting parts alternately aligned with the plurality of the coil parts, each of the plurality of connecting parts being located at a position same as a position of the connecting part when viewed from the laminated direction and having a shape same as a shape of the connecting part. Each of the plurality of connecting parts is connected only to the second end of the pair of ends of a corresponding one of the plurality of coil parts positioned on the upper side in the laminated direction, and is connected only to the first end of the pair of ends of a corresponding one of the plurality of coil parts positioned on the lower side in the laminated direction. In this case, a coil can be structured in which the plurality of coil parts and the plurality of connecting parts are alternately aligned without misaligning the positions of the respective plurality of connecting parts. This makes it possible to design the entire shapes of the respective coil parts to be the exact same shape, reducing the number of types of the coil parts.

Note that at least one of the first end and the second end may have an end face forming a stepped portion. The insulating body may be formed of a magnetic material. The multilayer coil component may include a low magnetic permeability layer in a layer same as a layer of the connecting part.

DETAILED DESCRIPTION

Figure 1:
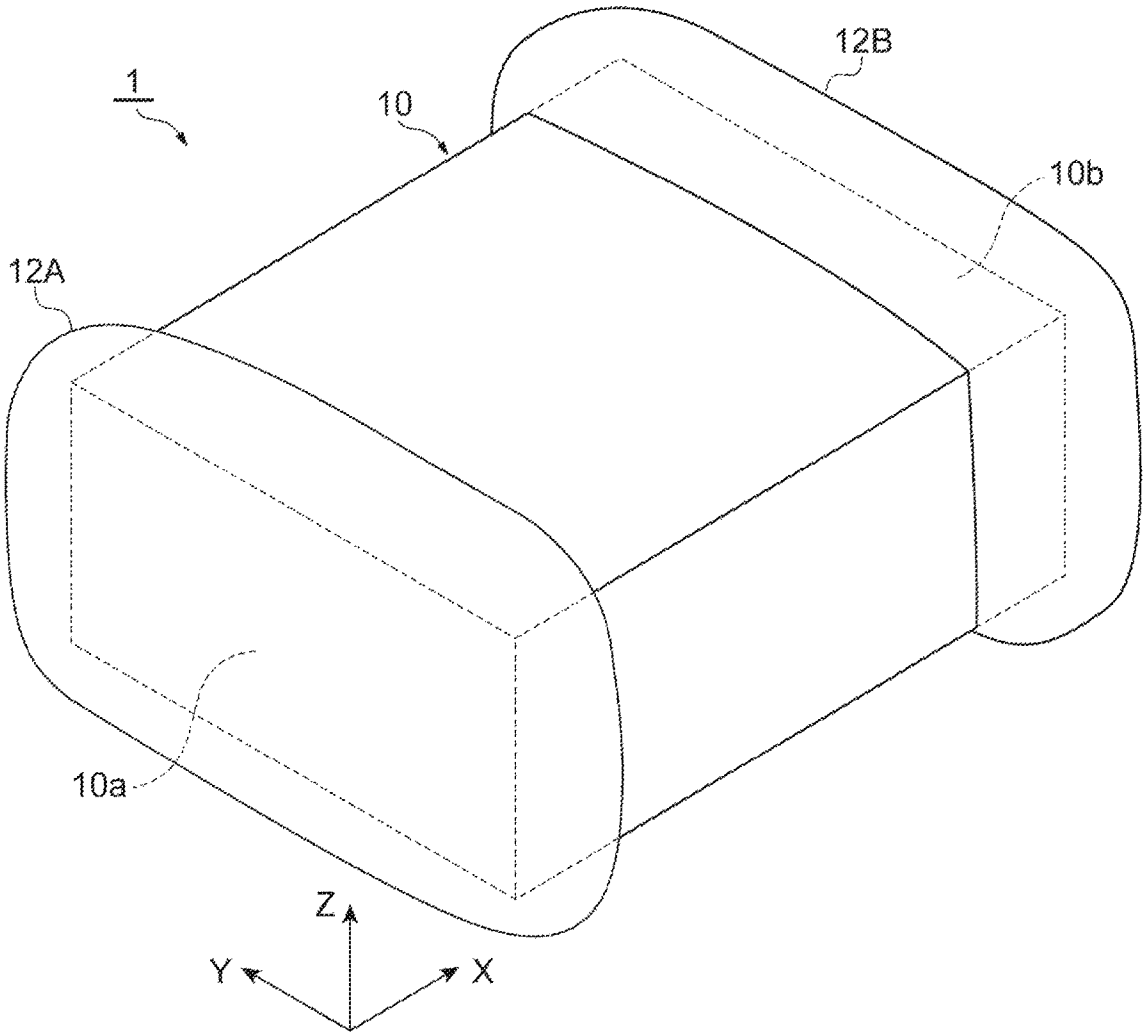
FIG. 1 is a schematic perspective view of a multilayer coil component according to an embodiment of the present disclosure.

Hereinafter, an embodiment of the disclosure will be described with reference to the accompanying drawings. Note that the same reference numerals are used for the same elements or elements having the same functions, and the overlapped description will be omitted.

First, the entire structure of a multilayer coil component 1 according to an embodiment of the disclosure will be described with reference to FIGS. 1 and 2.

Figure 2:
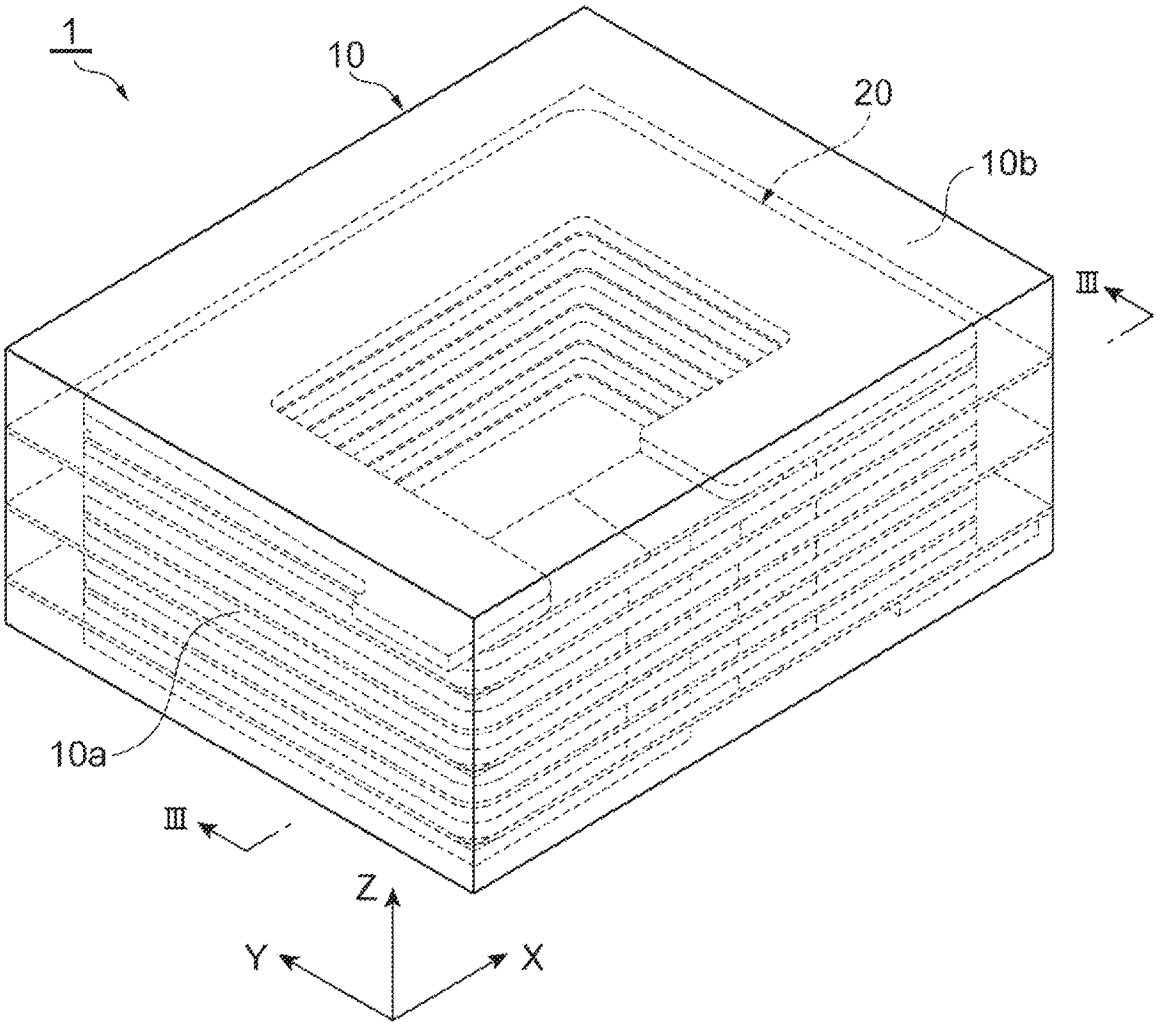
FIG. 2 is a perspective view schematically illustrating an inner structure of an insulating body of the multilayer coil component illustrated in FIG. 1.

As illustrated in FIG. 1, the multilayer coil component 1 is formed of an insulating body 10 having an outer shape of an approximate rectangular parallelepiped shape, and a coil 20 formed inside the insulating body 10. The multilayer coil component has a laminated structure including layers L1 to L20 as shown in FIGS. 1 and 2. Note that, external terminal electrodes 12A, 12B are provided on a pair of opposed end faces 10*a*, 10*b* of the insulating body 10, respectively. As an example, the multilayer coil component 1 is designed to be 2.0 mm in the long side, 1.6 mm in the short side, and 0.9 mm in the height.

For convenience of description, XYZ coordinates are set as illustrated in the drawings. That is, a laminated direction of the multilayer coil component 1 is set as Z direction, an opposing direction of the end faces 10*a*, 10*b* on which the respective external terminal electrodes are provided is set as X direction, and a direction perpendicular to Z direction and X direction is set as Y direction.

The insulating body 10 is formed of a magnetic material, and can be formed of a ferrite (for example, Ni—Cu—Zn system ferrite, Ni—Cu—Zn—Mg system ferrite, Cu—Zn system ferrite), a metal magnetic material (Fe, Fe—Si, Fe—Si—Cr, Fe—Si—Al alloy, etc.), or a composite material of a metal and a ferrite. The upper most layer L1 and the lower most layer L20, which are covering layers, among the layers L1 to L20 structuring the multilayer coil component 1 are totally formed of a magnetic material. The other layers is also formed of a magnetic layer except a part where the coil 20 is formed and parts where low magnetic permeability layers 29 to be described below are formed.

Figure 3:
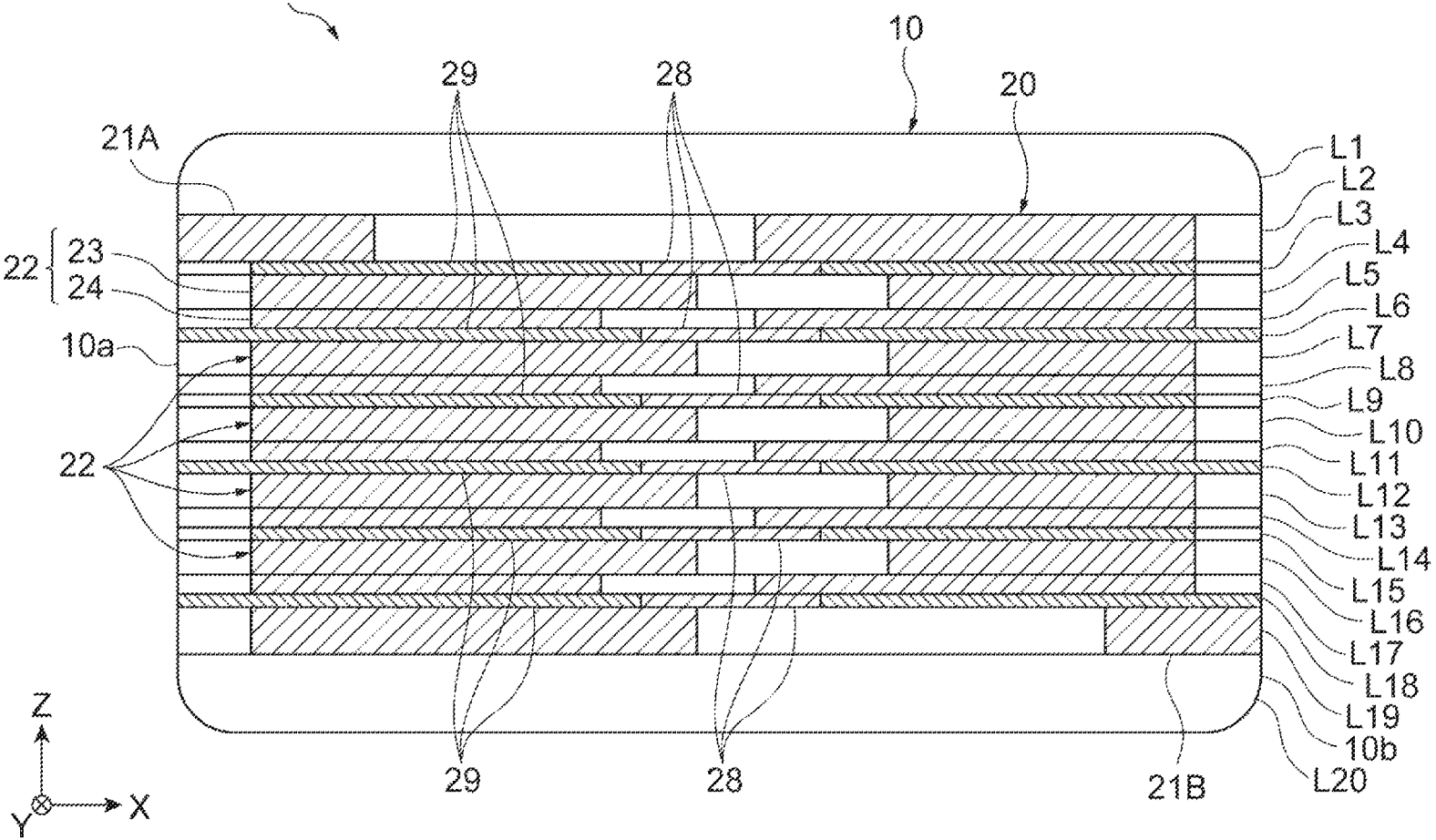
FIG. 3 is a cross sectional view taken along line III-III of the insulating body illustrated in FIG. 2.

The coil 20 is formed of a plurality of laminated metal layers. The material of the metal layers is not specifically limited and includes Ag, Cu, Au, Al, Pd, Pd/Ag alloy, etc. A Ti compound, a Zr compound, a Si compound, etc. may be added to the metal layers. Such metal layers can be formed by a printing method or a thin film growing method. As shown in FIG. 3, the coil 20 includes a lead-out electrode 21A extended to one end face 10*a* on which the external terminal electrode 12A is provided, and a lead-out electrode 21B extended to the other end face 10*b* on which the external terminal electrode 12B is provided.

Figure 4:
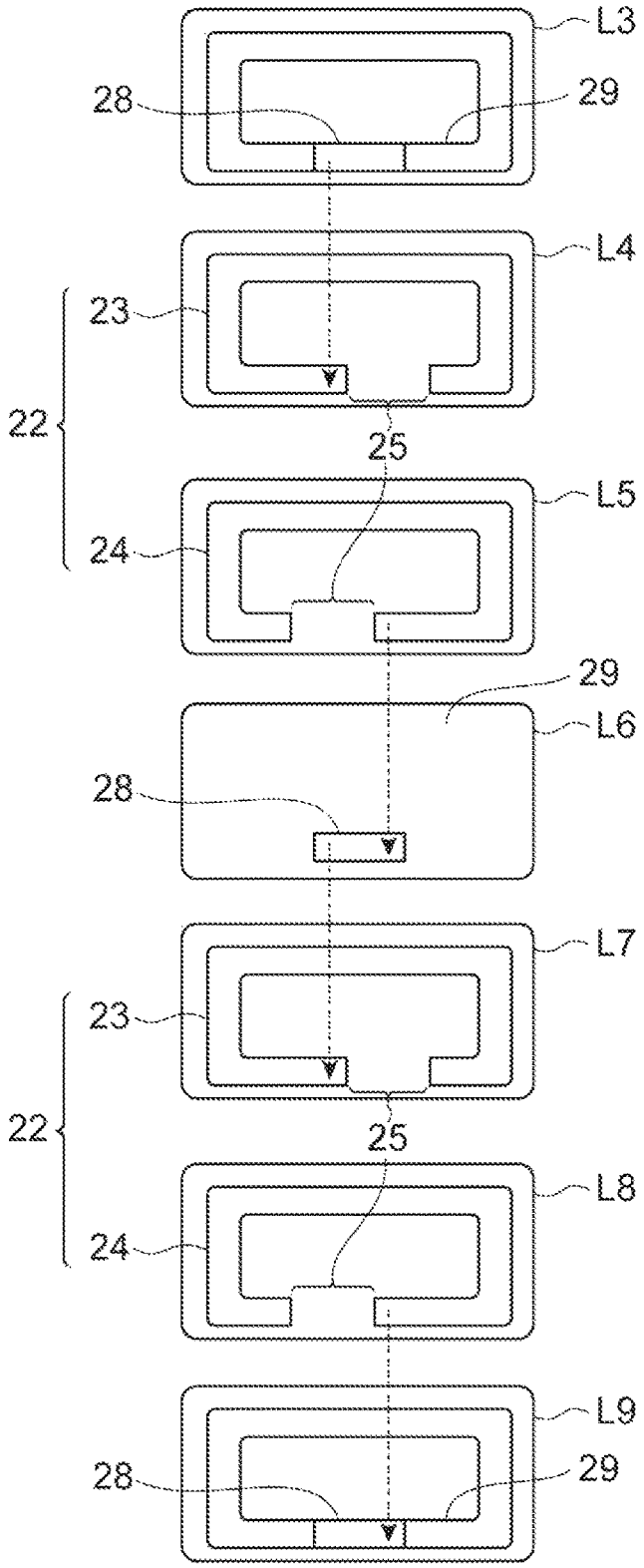
FIG. 4 is a diagram illustrating parts of a layer configuration of the multilayer coil component illustrated in FIG. 1.

As shown in FIGS. 3 and 4, the coil 20 includes a plurality of coil parts 22 each structuring one turn of the coil and a plurality of connecting parts 28 each connecting the corresponding two coil parts 22. The coil parts 22 having the same shape and the connecting parts 28 having the same shape are alternately aligned in the laminated direction. Note that each of the coil parts 22 in the embodiment is formed of two metal layers that are an upper coil layer 23 and a lower coil layer 24, and each of the connecting parts 28 is formed of one metal layer. As an example, the thickness of the upper coil layer 23 is 43 μm, the thickness of the lower coil layer 24 is 20 μm, and the thickness of the connecting part 28 is 18 μm.

Herein, the coil part 22 has an approximate annular shape having a divided portion 25 as its portion when viewed from the laminated direction. The coil part 22 may have a C character shape as shown in FIG. 4. The coil part 22 has a pair of ends formed of a first end 22*a* and a second end 22*b* sandwiching the divided portion 25 and opposing to each other via the divided portion 25.

In this regard, a position of the divided portion 25 in the upper coil layer 23 and a position of the divided portion 25 in the lower coil layer 24 are misaligned in the opposing direction of the first end 22*a* and the second end 22*b* (that is, X direction), forming a stepped portion 26 on each of end faces of the ends 22*a*, 22*b*. More specifically, in the first end 22*a*, the upper coil layer 23 is extended on the side of the divided portion 25 more than the lower coil layer 24 to form the stepped portion 26. In contrast, in the second end 22*b*, the lower coil layer 24 is extended on the side of the divided portion 25 more than the upper coil layer 23 to form the stepped portion 26.

The connecting part 28 is arranged at the position corresponding to the position of the divided portion 25 of the coil part 22, and has a rectangular shape extending along the opposing direction of the pair of ends 22*a*, 22*b* (that is, along the shape of the divided portion 25). The connecting part 28 connects the upper and lower coil parts 22 adjacent vertically to each other in the laminated direction. That is, the connecting part 28 is arranged in an annular coil forming area when viewed from the laminated direction, ensuring a sufficient inner diameter of the coil.

Each of the layers L3, L6, L9, L12, L15, L18 each including the connecting part 28 includes the low magnetic permeability layer 29 formed of a material having a low magnetic permeability (for example, non-magnetic material) in addition to the connecting part 28. More specifically, the low magnetic permeability layer 29 having a C character shape like the coil part 22 is formed in some layers (L3, L9, L15) including the connecting part 28, and the low magnetic permeability layer 29 is formed in the entire residual area excluding the connecting part 28 in other layers (L6, L12, L18) including the connecting part 28. The low magnetic permeability layers 29 form a magnetic gap, improving DC bias characteristics.

Figure 5:
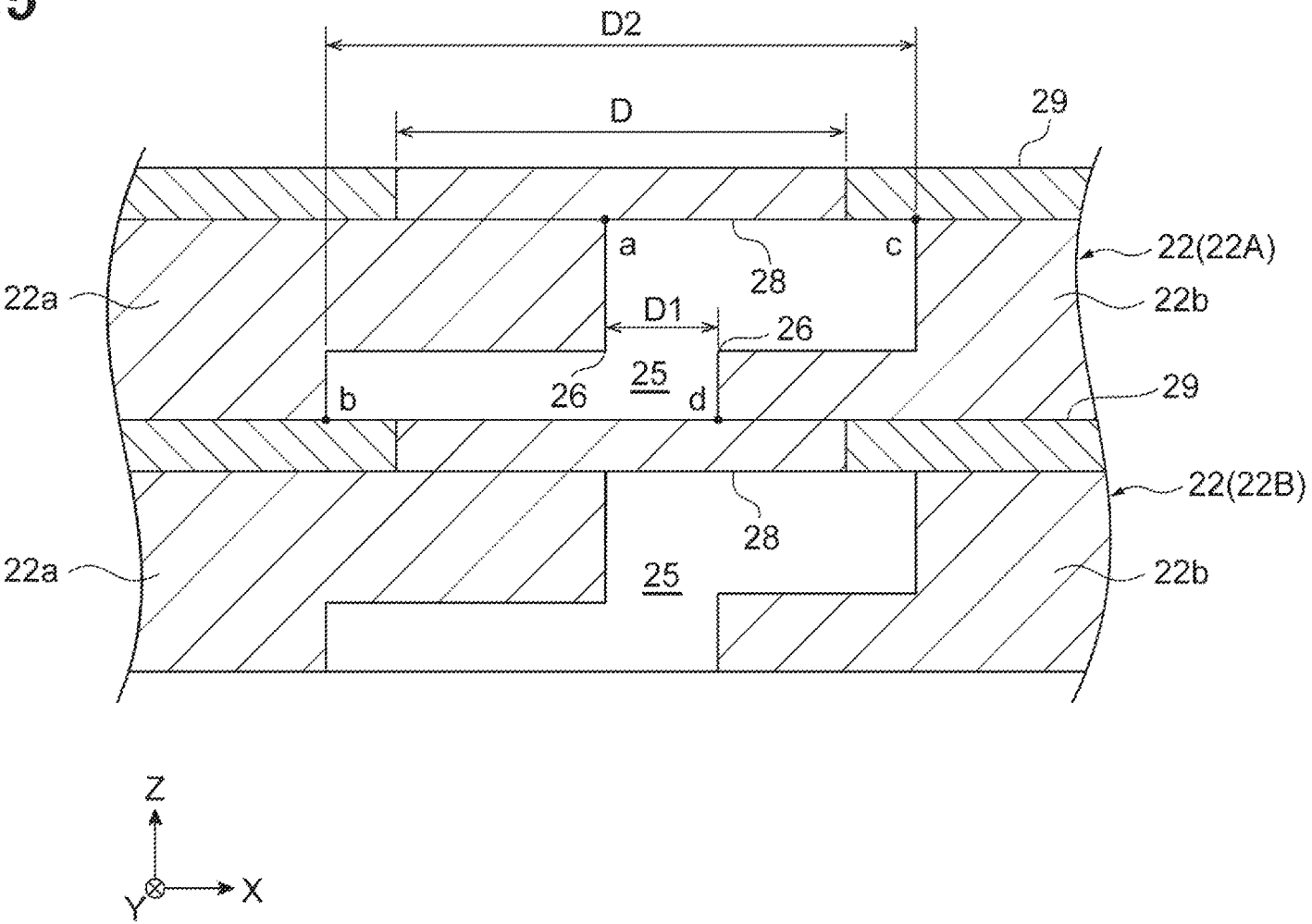
FIG. 5 is a diagram illustrating a positional relationship between coil parts and a connecting part of the multilayer coil component illustrated in FIG. 1.

Next, a positional relationship between the coil part and the connecting part will be described in more detail with reference to FIG. 5. FIG. 5 is a vertical section (X-Z cross section) parallel to the opposing direction (X direction) in which the pair of ends 22*a*, 22*b* of the coil part 22 are opposed, and illustrates the upper end position and the lower end position of the first end 22*a* in the laminated direction as an a point and a b point, respectively, and illustrates the upper end position and the lower end position of the second end 22*b* in the laminated direction as a c point and a d point, respectively. Note that, of the two coil parts 22 in FIG. 5, the coil part 22 on the upper side and the coil part 22 on the lower side are also referred to as a first coil part 22A and a second coil part 22B, respectively, as needed.

As illustrated in FIG. 5, the b point, the a point, the d point, and the c point are aligned without overlapping in this order from the side of the first end 22*a* in the opposing direction of the ends 22*a*, 22*b* of the coil part 22 (first coil part 22A).

The a point at the upper end position of the first end 22*a* is located on the connecting part 28 on the upper side, and the first end 22*a* is connected to the connecting part 28 on the upper side. The b point at the lower end position of the first end 22*a* is located at a retreated position with respect to the connecting part 28 on the lower side, and the first end 22*a* is not connected to the connecting part 28 on the lower side.

The c point at the upper end position of the second end 22*b* is located at a retreated position with respect to the connecting part 28 on the upper side, and the second end 22*b* is not connected with the connecting part 28 on the upper side. The d point at the lower end position of the second end 22*b* is located on the connecting part 28 on the lower side, and the second end 22*b* is connected to the connecting part 28 on the lower side.

Note that the length D of the connecting part 28 in the opposing direction is designed to be longer than the separation distance D1 between the a point at the upper end position of the first end 22*a* and the d point at the lower end position of the second end 22*b*, and to be shorter than the separation distance D2 between the b point at the lower end position of the first end 22*a* and the c point at the upper end position of the second end 22*b*.

As shown in FIG. 5, the shapes of the pair of ends 22*a*, 22*b* of the second coil part 22B on the lower side are same as the shapes of the pair of ends 22*a*, 22*b* of the first coil part 22A on the upper side. Furthermore, when viewed from the laminated direction, the pair of ends 22*a*, 22*b* of the second coil part 22B is located at the positions same as the positions of the pair of ends 22*a*, 22*b* of the first coil part 22A. Note that, not only the first coil part 22A and second coil part 22B, but also the other coil parts 22 have the pair of ends 22*a*, 22*b* having the same shapes and being located at the same positions when viewed from the laminated direction. Furthermore, each of the pairs of ends 22*a*, 22*b* are the same shapes, making each of the divided portions 25 sandwiched by the corresponding pair of ends 22*a*, 22*b* same in shape.

Furthermore, as shown in FIGS. 4 and 5, each of the plurality of connecting parts 28 structuring the coil 20 has the same shape (that is, rectangular shape) and is located at the same position when viewed from the laminated direction.

As described above, in the multilayer coil component 1, the coil parts 22 each having the pair of ends 22*a*, 22*b* having the same shapes, and the connecting parts 28 each having the same shape are alternately aligned in the laminated direction, and any of the coil parts 22 and the connecting parts 28 has the same positional relationship. That is, each connecting part 28 connects the coil parts 22 adjacent vertically to each other in the laminated direction by connecting the second end 22*b* of the first coil part 22A on the upper side in the laminated direction, and the first end 22*a* of the second coil part 22B on the lower side in the laminated direction. Such a connection structures the coil 20 wound around along the laminated direction that allows current to flow in the coil parts 22 adjacent vertically to each other in a same circumferential direction.

As described above, in the multilayer coil component 1, even when the pair of ends 22*a*, 22*b* of each of the first coil part 22A and the second coil part 22B are located at the same positions when viewed from the laminated direction and have the same shapes, the connecting part 28 is connected only to the second end 22*b* of the first coil part 22A on the upper side in the laminated direction, and is connected only to the first end 22*a* of the second coil part 22B on the lower side in the laminated direction. This makes it possible to form the coil 20 wound around along the laminated direction without misaligning the positions of the respective connecting parts 28 even when the connecting part 28 is further provided on the upper side of the first coil part 22A or on the lower side of the second coil part 22B.

Therefore, in the multilayer coil component 1, the entire shape of each of the plurality of coil parts 22 can be designed to be the exact same shape, which makes it possible to reduce the number of types of coil part 22, saving labor and time for preparing many types of conductor patterns like the conventional type.

Furthermore, in the multilayer coil component 1, when viewed from the laminated direction, the connecting part 28 is arranged in the coil formation area to ensure a large inner diameter of the coil, making it possible to achieve high coil characteristics (for example, inductance or Q-value).

Furthermore, in the multilayer coil component 1, the coil parts 22 adjacent vertically to each other are not overlapped to each other in the connecting part 28, suppressing increase of the thickness of the connecting part 28. This also suppresses occurrence of large inner stress around the connecting part 28.

One method of manufacturing the above multilayer coil component 1 using, for example, a printing method is repeating printing from the lower most layer L20 to laminate layers one by one. In this case, the cross sections of the coil part 22, etc. probably have a gently curved outline different from the angular outline as illustrated in FIGS. 3 and 5.

Alternatively, it is also possible that a plurality of layers (for example, three layers of L3 to 5) is formed as one unit, and a plurality of the units is overlapped to manufacture the multilayer coil component 1. In this case, it is possible to efficiently manufacture the multilayer coil component 1 as compared with the method of laminating layers one by one by a printing method.

Note that the multilayer coil component is not limited to the above embodiment, and can be modified in various manners.

For example, the planer shape of the coil part may be a circle annular shape, an ellipsoidal annular shape, etc. other than a rectangular annular shape. Furthermore, each coil part does not necessarily need to be the exact same shape as the entire shape as long as at least the shapes of the pair of ends are same shapes. Furthermore, it is not necessary that the coil part forms one turn, and a coil part forming one half turn or one quarter turn may be employed. Furthermore, the coil part does not necessarily need to be two layer structure, and single layer structure or multilayer structure of not less than three layers may be employed. The number of the laminated layers of the multilayer coil component can be increased or reduced in any manner as needed.

It is not necessary to form the stepped portion on the end face of each of ends of the coil part, and the end face may be a slope face sloped in the laminated direction, for example.

Furthermore, it is not necessary that the connecting part has a shape extending in one direction when viewed from the laminated direction, and may have a bend shape or a curved shape. For example, when the shape of the coil part in plan view is a polygonal annular shape, using a connecting part having a bent shape or a curved shape makes it possible to connect upper and lower coil parts at the position corresponding to a corner of the coil part.

What is claimed is:

1. A multilayer coil component having a laminated structure and including a coil in an insulating body, the multilayer coil component comprising:

a first coil part that structures a part of the coil, extends in a layer structuring the laminated structure, and has a divided portion and a pair of ends formed of a first end and a second end sandwiching the divided portion;

a second coil part that structures a part of the coil, extends in a layer structuring the laminated structure, and has a divided portion and a pair of ends, the second coil part being positioned on a lower side of the first coil part in a laminated direction, the divided portion and the pair of ends of the second coil part having shapes same as shapes of the divided portion and the pair of ends of the first coil part and being located at positions same as positions of the divided portion and the pair of ends of the first coil part when viewed from the laminated direction; and a connecting part having a layer shape interposed between the first coil part and the second coil part and extended along the shape of the divided portion of the first coil part to connect the first coil part and the second coil part, wherein in the pairs of ends of the first coil part and the second coil part, the first end has an upper portion and a lower portion in the laminated direction, the upper portion being extended on a side of the second end more than the lower portion, and the second end has an upper portion and a lower portion in the laminated direction, the lower portion being extended on a side of the first end more than the upper portion, and the connecting part is connected only to the second end of the pair of ends of the first coil part on an upper side in the laminated direction, and is connected only to the first end of the pair of ends of the second coil part on a lower side in the laminated direction.

2. The multilayer coil component according to claim 1 comprising:

a plurality of coil parts each structuring a part of the coil, extending in a layer structuring the laminated structure, and having a divided portion and a pair of ends, the divided portion and the pair of ends having shapes same as the shapes of the divided portion and the pair of ends of the first coil part and being located at positions same as the positions of the divided portion and the pair of ends of the first coil part when viewed from the laminated direction; and a plurality of connecting parts alternately aligned with the plurality of the coil parts, each of the plurality of connecting parts being located at a position same as a position of the connecting part when viewed from the laminated direction and having a shape same as a shape of the connecting part, wherein each of the plurality of connecting parts is connected only to the second end of the pair of ends of a corresponding one of the plurality of coil parts positioned on the upper side in the laminated direction, and is connected only to the first end of the pair of ends of a corresponding one of the plurality of coil parts positioned on the lower side in the laminated direction.

3. The multilayer coil component according to claim 1, wherein at least one of the first end and the second end has an end face forming a stepped portion.

4. The multilayer coil component according to claim 1, wherein the insulating body is formed of a magnetic material.

5. The multilayer coil component according to claim 1 comprising a low magnetic permeability layer in a layer same as a layer of the connecting part.

6. A multilayer coil component having a laminated structure and including a coil in an insulating body, the multilayer coil component comprising:

a first coil part that structures a part of the coil, extends in a layer structuring the laminated structure, and has a pair of ends formed of a first end and a second end being separated by a predetermined length and opposed to each other;

a second coil part that structures a part of the coil, extends in a layer structuring the laminated structure, and has a pair of ends, the second coil part being positioned on a lower side of the first coil part in a laminated direction, the pair of ends of the second coil part having shapes same as shapes of the pair of ends of the first coil part and being located at positions same as positions of the pair of ends of the first coil part when viewed from the laminated direction; and a connecting part having a layer shape interposed between the first coil part and the second coil part and extended along an opposing direction of the pair of ends to connect the first coil part and the second coil part, wherein in each of the pairs of ends of the first coil part and the second coil part, given that an upper end position and a lower end position of the first end in the laminated direction are an a point and a b point, respectively, and an upper end position and a lower end position of the second end in the laminated direction are a c point and a d point, respectively, in a vertical section parallel to the opposing direction of the pair of ends, the b point, the a point, the d point, and the c point are aligned without overlapping in this order from a side of the first end in the opposing direction, a length D of the connecting part is longer than a separation distance between the a point and the d point, and shorter than a separation distance between the b point and the c point in the opposing direction, and the connecting part is connected only to the second end of the pair of ends of the first coil part on an upper side in the laminated direction, and is connected only to the first end of the pair of ends of the second coil part on a lower side in the laminated direction.

7. The multilayer coil component according to claim 6 comprising:

a plurality of coil parts each structuring a part of the coil, extending in a layer structuring the laminated structure, and having a pair of ends, each of the pair of ends having shapes same as the shapes of the pair of ends of the first coil part and being located at positions same as the positions of the pair of ends of the first coil part when viewed from the laminated direction; and a plurality of connecting parts alternately aligned with the plurality of the coil parts, each of the plurality of connecting parts being located at a position same as a position of the connecting part when viewed from the laminated direction and having a shape same as a shape of the connecting part, wherein each of the plurality of connecting parts is connected only to the second end of the pair of ends of a corresponding one of the plurality of coil parts positioned on the upper side in the laminated direction, and is connected only to the first end of the pair of ends of a corresponding one of the plurality of coil parts positioned on the lower side in the laminated direction.

8. The multilayer coil component according to claim 6, wherein at least one of the first end and the second end has an end face forming a stepped portion.

9. The multilayer coil component according to claim 6, wherein the insulating body is formed of a magnetic material.

10. The multilayer coil component according to claim 6 comprising a low magnetic permeability layer in a layer same as a layer of the connecting part.

* * * * *